US005308401A

United States Patent [19]

Geke et al.

[11] Patent Number: 5,308,401

[45] Date of Patent: May 3, 1994

[54] METHOD OF CLEANING A COMBINATION OF IONIC AND NONIONIC SURFACTANTS

[75] Inventors: Juergen Geke, Duesseldorf; Bernd Stedry, Kempen; Raina Hirthe, Cologne, all of Fed. Rep. of Germany

[73] Assignee: Henkel Kommanditgesellschaft auf Aktien, Duesseldorf, Fed. Rep. of Germany

[21] Appl. No.: 946,367

[22] PCT Filed: Apr. 30, 1991

[86] PCT No.: PCT/EP91/00823

§ 371 Date: Nov. 9, 1992

§ 102(e) Date: Nov. 9, 1992

[87] PCT Pub. No.: WO91/17233

PCT Pub. Date: Nov. 14, 1991

[30] Foreign Application Priority Data

May 9, 1990 [DE] Fed. Rep. of Germany ..... 4014859

[51] Int. Cl.[5] ..... C11D 1/835

[52] U.S. Cl. ..... 134/2; 134/40; 252/547

[58] Field of Search ..... 252/547, DIG. 14; 134/40, 42, 2

[56] References Cited

U.S. PATENT DOCUMENTS

| | | | |
|---|---|---|---|
| 4,443,363 | 4/1984 | Klinger et al. | 252/547 |
| 4,443,364 | 4/1984 | Klinger et al. | 252/547 |
| 4,609,488 | 9/1986 | Geke et al. | 252/344 |
| 4,780,237 | 10/1988 | Schmid et al. | 252/174.22 |
| 4,814,108 | 3/1989 | Geke et al. | 252/545 |
| 4,820,344 | 4/1989 | Geke et al. | 106/14.13 |

FOREIGN PATENT DOCUMENTS 2556499 12/1975 Fed. Rep. of Germany .

*Primary Examiner*—R. Bruce Breneman
*Assistant Examiner*—Thomas G. Dunn, Jr.
*Attorney, Agent, or Firm*—Ernest G. Szoke; Wayne C. Jaeschke; Norvell E. Wisdom, Jr.

[57] ABSTRACT

The present invention relates to the use for cleaning hard surfaces of a combination of ionic and nonionic surfactants containing (a) at least one quaternary ammonium compound having the general formula (I)

$$R^1(\text{—CHOH—CHR}^2)_n\text{—N}^+R^3R^4R^5X^- \quad \text{(I)}$$

(b) at least one alk(en)yl polyethylene glycol mixed ether having the general formula (II):

$$R^6\text{—O—}(CH_2CH_2\text{—O})_2\text{—}R^7 \quad \text{(II).}$$

20 Claims, No Drawings

METHOD OF CLEANING A COMBINATION OF IONIC AND NONIONIC SURFACTANTS

FIELD OF THE INVENTION

This invention relates to the use of a combination of ionic and nonionic surfactants—optionally with conventional additives—for cleaning hard surfaces. "Industrial cleaners" are usually used for such purposes.

STATEMENT OF RELATED ART

Such industrial cleaners are mainly used in spray cleaning stations in the automotive industry and in the supplier industries thereof for cleaning and passivation. They are suitable for intermediate cleaning and final cleaning of parts that have been subjected to chipless e working or machining in fabrication and assembly plants. Virtually all relevant materials, such as iron and steel, aluminum, Silumin®, copper, brass, zinc, and plastics, can be treated, and the majority of all of the organic or inorganic contaminations, such as cooling lubricants, rust proofing oils, working oils, drawing aids, pigments, and light abraded metal dust, can be removed. Such cleaning agents may also be used in conventional immersion procedures; however, the application thereof in spraying procedures is usually preferred.

The chemical base components of such industrial cleaners usually are surfactants and organic corrosion inhibitors. The latter assure a temporary protection from corrosion during and after the treatment. As a rule, such cleaning agents additionally contain substances which are capable of counteracting undesired foam formation. The use of such foam-inhibiting additives in most cases is caused by the fact that the contaminations accumulated in the cleaning baths act as foam-forming materials. Moreover, it may be required to employ so-called antifoam agents due to the fact that the cleaning agents themselves contain components which under the given working conditions—i.e. especially in spraying processes—give rise to an undesirable foam formation; for example, anionic surfactants and some nonionic surfactants tend to foam at actual working temperatures.

From *Ullmanns Encyklopadie technischen Chemie* [English translation of title: Ullmann's Encyclopedia of Technical Chemistry], 4th Edition, Volume 22 (1982), pages 489 to 493, there has been known the use of fatty alcoholpolyethylene glycol ethers—also designated as fatty alcohol ethoxylates—as surfactant component in washing and cleaning agents. However, such addition products of ethylene oxide to fatty alcohols are not suitable for use in spraying operations, because they strongly foam when applied at temperatures within the range of from 15° C. to 80° C. It has further been known to employ fatty alcohol ethoxylate-propoxylates as weakly foaming detergent raw materials; cf., Ullmann, loc. cit., page 494.

DE-A-36 20 011 describes cationic surfactants based on quaternary ammonium compounds and the use thereof in cleaners. The cationic surfactants are employed in the alkaline pH range, along with other cleaner constituents.

EP-A-0 116 151 describes a process for regenerating and/or recycling aqueous degreasing and cleaning solutions by the addition of cationic surfactants or cationically modified polymers or mixtures thereof.

EP-A-0 054 895 describes a surfactant mixture comprising a non-ionic surfactant and a quaternary ammonium compound as a cationic surfactant for cleaning hard surfaces. The nonionic surfactant is present in the mixture in an amount of from 20 to 95% by weight, and the cationic surfactant is present in an amount of from 5 to 80% by weight.

DESCRIPTION OF THE INVENTION

Object of the Invention

In comparison, it was the object of the present invention to provide surfactant combinations for cleaning hard surfaces, which surfactant combinations in the total range of temperatures which is of practical technical relevance, namely in the range of from 15° to 80 ° C., exhibit low foaming properties and, hence, are suitable for use in spraying processes. Moreover, these surfactant combinations are intended to have a high cleaning power and excellent wetting properties relative to the substrate to be treated therewith; furthermore, said surfactant combinations should be readily compoundable with the additives conventional in industrial cleaners, should allow the cleaner solutions to run off well from, without leaving visible spots on, the treated substrate surfaces, and should have demulsifying properties with respect to oils and fats which are not self-emulsifying. It is further intended to achieve advantageous electrostatic effects.

SUMMARY OF THE INVENTION

Surprisingly, it has been found that mixtures comprising specific ionic and non-ionic surfactants over a wide mixing range will fully meet the requirements described as the object above.

Thus, the present invention relates to the use, for cleaning hard surfaces, of a combination of ionic and nonionic surfactants, containing:

(a) at least one quaternary ammonium compound having the general formula (I):

$$R^1(\text{—CHOH—CHR}^2)_n\text{-N}^+R^3R^4R^5X^- \quad \text{(I)},$$

wherein $R^1$ represents a linear or branched alkyl group having from 1 to 22 carbon atoms; $R^2$ represents hydrogen or a linear or branched alkyl group having from 1 to 21 carbon atoms, the total number of the carbon atoms of the substituents $R^1$ and $R^2$ being within the range of from 9 to 22; n=0 or 1; $R^3$ and $R^4$ represent methyl, ethyl, 2-hydroxyethyl, or hydroxypropyl; $R^5$ represents an alkyl group having from 4 to 6 carbon atoms or a phenylalkyl group having from 1 to 3 carbon atoms in the alkyl moiety; and $X^-$ represents a halide or the anion of an organic acid having from 4 to 15 carbon atoms; and (b) at least one alk(en)yl polyethylene glycol mixed ether having the general formula (II):

$$R^6\text{—O—}(CH_2CH_2\text{—O})_s\text{—}R^7 \quad \text{(II)}$$

wherein $R^6$ represents a linear or branched alkyl group or alkenyl group having from 6 to 18 carbon atoms or a cyclic alkyl group having from 5 to 6 carbon atoms; s represents a number within the range of from 2 to 5; and $R^7$ represents a linear or branched alkyl group having from 1 to 8 carbon atoms or a benzyl group, the ratio by weight of the components (a):(b) being within the range of from 20:1 to 1:20.

DESCRIPTION OF PREFERRED EMBODIMENTS

Particularly preferred is a ratio by weight of the components (a):(b) of from 2:1 to 1:10.

Particularly preferred anions $X^-$ of the quaternary ammonium compounds are, more specifically, benzoate or benzoate which has been mono-substituted with $CH_3$, $NH_2$, $NO_2$, COOH, OH or $SO_3H$ or isononanoate as anions of organic acids. As a halide there is especially used chloride or bromide.

Especially suitable as the quaternary ammonium compound are lauryldimethylbenzylammonium chloride, N-benzyl-N-2-hydroxydodecyl-N,N-dimethylammonium iso-nonanoate or N-benzyl-N-2-hydroxydodecyl-N,N-dimethylammoniumbenzoate.

In the general formula (II) of the surfactant component (b), $R^6$ of course represents a linear or branched alkyl group or alkenyl group having from 6 to 18 carbon atoms or a cyclic alkyl group having from 5 to 6 carbon atoms. Thus, the substituents $R^6$ may include the following groups: n-hexyl, n-heptyl, n-octyl, n-nonyl, n-decyl, n-undecyl, n-dodecyl, n-tridecyl, n-tetradecyl, n-penta decyl, n-hexadecyl, n-heptadecyl, and n-octadecyl as well as the branched chain isomers of said alkyl groups. The number of the ethoxy moieties in the molecule—the index s—here is within the range of from 2 to 5. The substituent $R^7$ in the general formula (II) represents a linear or branched alkyl group having from 1 to 8 carbon atoms, i.e. methyl, ethyl, n-propyl, n-butyl, n-pentyl, n-hexyl, n-heptyl, n-octyl as well as the corresponding branched-chain isomers or a benzyl group. Such alk(en)yl ethoxylate mixed ethers, which are also designated as end-capped fatty alcohol polyethylene glycol ethers, are described in greater detail in the German Published Unexamined [Laid-Open] Patent Applications DE-OS's 33 15 951, 37 27 378, and 38 00 490. In these DE-OS's there has also been disclosed the preparation of said nonionic surfactants.

Within the meaning of the invention it is preferred to use, as the component (b) of the surfactant combination, at least one alkyl ethoxylate mixed ether of the general formula (II), wherein $R^6$ represents a linear alkyl group having from 8 to 10 carbon atoms, s represents a number within the range of from 3 to 5, and $R^7$ represents a n-butyl group. Particularly preferred alkyl ethoxylate mixed ethers of the general formula (II) are adducts of from 3.5 to 4.5 moles of ethylene oxide with fatty alcohols having from 8 to 10 carbon atoms, which have been etherified with an n-butyl group.

The surfactant combination according to the invention fully meets the requirements for solving the problems defined above. The combination according to the invention of the specific components (a) and (b) not only has a high cleaning power, but also causes anionic surfactants and/or emulsifiers to be efficiently demulsified while—even when used in a spray procedure—no undesirable foam formation occurs.

If so desired, still further components may be added to the surfactant combination consisting of the components (a) and (b). Said further components may include:

(c) at least one alk(en)yl ethoxylate having the general formula (III):

$$R^8—O(CH_2CH_2—O)_m—H \quad (III),$$

wherein $R^9$ represents a linear or branched alkyl group or alkenyl group having from 6 to 18 carbon atoms or a cyclic alkyl group having from 5 to 6 carbon atoms, and m represents a number within the range of from 2 to 12; and/or (d) at least one alk(en)yl ethoxylate-propoxylate having the general formula (IV):

$$R^9—O(CH_2CH_2O)_p—A—H \quad (IV),$$

wherein $R^9$ represents a linear or branched alkyl group or alkenyl group having from 6 to 18 carbon atoms or a cyclic alkyl group having from 5 to 6 carbon atoms; p represents a number within the range of from 2 to 10; and A represents moieties of the types:

$$—(CH_2—CH(CH_3)—O)_q \text{ and } —(CH(CH_3)—CH_2—O)_r—,$$

the sum of (q+r) being a number within the range of from 2 to 8.

With respect to the optionally usable surfactant components (c) and (d), the following details are applicable:

In the above-mentioned general formula (III) of the components (c) $R^8$ represents a linear or branched alkyl group or alkenyl group having from 6 to 18 carbon atoms. Thus, as the substituent $R^8$ there may be taken into consideration all those groups which have already been mentioned above in connection with the substituent $R^6$ of the general formula (II). In the place of the saturated alkyl group, $R^8$ may also represent the unsaturated alkyl groups (alkenyl groups) having a number of carbon atoms within the range indicated above, which groups likewise may be linear or branched. Furthermore, $R^8$ may also represent a cyclic alkyl group having from 5 to 6 carbon atoms, i.e., cyclopentyl or cyclohexyl. The number of the ethoxy moieties in the molecule—the index m—is within the range of from 2 to 12.

It is preferred within the scope of the invention to use as the component (c) those compounds having the general formula (III), wherein $R^8$ represents a linear alkyl group or alkenyl group having from 6 to 18 carbon atoms and m e represents a number within the range of from 2 to 10. According to a particularly preferred embodiment of the present invention, there is used, as the surfactant component (c), the reaction product of octanol ($R^8$=linear alkyl group having 8 carbon atoms) with 4 moles of ethylene oxide.

With respect to the preparation of compounds having the general formula (III), reference may be made, for example, to the above-quoted article in Ullmann, loc. cit. Such products are also commercially available, for example under the trademark Dehydol® (Henkel KGaA, Düsseldorf).

In the above-mentioned general formula (IV) of the surfactant components (d), $R^9$ represents a linear or branched alkyl group or alkenyl group having from 6 to 18 carbon atoms or a cyclic alkyl group having from 5 to 6 carbon atoms. Thus, as the substituent $R^9$ there may be taken into consideration all those groups which have already been mentioned above in connection with the substituent $R^6$ of the general formula (II). The number of the ethoxy moieties in the molecule—the index p—is within the range of from 2 to 10. The substituent A in the general formula (IV) denotes propoxy moieties, the number of the propoxy moieties—the sum of the indices (q+r)—being within the range of from 2 to 8.

It is preferred within the scope of the invention to use as the component (d) those compounds having the general formula (IV), wherein $R^9$ represents a linear alkyl group having from 8 to 18 carbon atoms, p represents a number within the range of from 2 to 5, and A represents propoxy groups, and the sum of (q+r) is a number within the range of from 4 to 6. According to a particularly preferred embodiment of the present invention, there is used, as the surfactant component (d), the reaction product of technical lauryl alcohol—which comprises alkyl groups having from 12 to 18 carbon atoms (about 80% of which have from 12 to 14 carbon atoms)—with from 2 to 4 moles of ethylene oxide and 4 to 6 moles of propylene oxide or the reaction product of n-octanol with from 2 to 6 moles of ethylene oxide and 2 to 5 moles of propylene oxide.

With respect to the preparation of compounds having the general formula (IV), reference may likewise be made, for example, to the above-quoted article in Ullmann, loc. cit. Such products are also commercially available, for example under the trademarks DEHYPONR®-LS and -LT, respectively (Henkel KGaA, Düsseldorf).

The surfactant combinations to be used according to the invention and comprising a cationic surfactant (a) and a non-ionic surfactant (b) are further distinguished by a definite ratio by weight of the components (a):(b), which generally is within the range of from 20:1 to 1:20, and preferably within the range of from 2:1 to 1:10.

If, in addition to the non-ionic surfactant (b), the non-ionic surfactants (c) and/or (d) are also present in the mixture, then the above numerical ratios are applicable also to the respective proportions (a):{(b)+(c)}, (a):{(b)+(d)}, and (a):{(b)+(c)+(d)}.

The mixed ethers in (b) and the optionally contained ethoxylated and/or propoxylated fatty alcohols (c) and/or (d), in the sum thereof, are understood to be non-ionic surfactants. The ratio of mixed ether (b) to ethoxylated and/or propoxylated fatty alcohols (c) and/or (d) is between 10:1 and 1:10.

The surfactant combinations to be used according to the invention are distinguished by a high cleaning capacity and demulsifying capacity at temperatures within the range of from 15° C. to 80° C. Moreover, in said temperature range they are usable with the spraying method without giving any problems, since they do not cause any undesirable foam formation to occur. Further advantages include very good wetting properties, providing a spot-free run-off from the cleaned articles of the cleaning liquids, very good demulsifying properties with respect to oils and fats which are not self-emulsifying, accomplishment of antistatic effects, good compoundability with additives as conventionally used in industrial cleaners and a very low foam height in the Götte frothing apparatus (DIN 53902).

As the additives which within the scope of the invention are preferably employed in addition to the surfactant combinations there are to be taken into consideration:

Builders and/or complexing agents, corrosion inhibitors, as well as bases or acids. Optionally there may further be used stabilizers, solubilizers, or antimicrobially active agents as additives.

As the builders and/or complex-forming agents there may be used, for example, alkali metal orthophosphates, polyphosphates, silicates, borates, carbonates, polyacrylates and gluconates, as well as phosphonic acids or phosphonoalkanoic carboxylic acids and/or the water soluble alkali metal salts thereof, for example, 1-hydroxyethane 1,1-diphosphonic acid or 2-phosphonobutane-1,2,4-tricarboxylic acid. Straight-chain or branched aliphatic carboxylic acids and/or salts thereof are suitable as efficient corrosion inhibitors. Here, alkanolamine salts of straight-chain or branched mono carboxylic acids having from 8 to 11 carbon atoms are preferably used as corrosion inhibitors. Depending on the purpose of application, the aqueous solutions of the surfactant combinations to be used according to the invention may be acidic or alkaline; accordingly, they may contain an excess of an acid or base, for example of sodium hydroxide and/or potassium hydroxide.

The preparation of the surfactant combinations to be used according to the invention is effected by simply mixing the individual components. In the same manner powdery or liquid cleaning agents are prepared by mixing the surfactant combinations to be used according to the invention with the other additives and optionally with water. Within the scope of the invention, such cleaning agents contain from 1 to 70% by weight, and preferably from 2 to 20% by weight, of the surfactant combinations to be used according to the invention.

Within the scope of the invention, the surfactant combinations to be used according to the invention are preferably used in the form of water diluted application solution. Such application solutions preferably contain the surfactant combinations to be used according to the invention in concentrations of from 0.0001 to 1.5% by weight, and especially from 0.0005 to 0.5% by weight. Such ready-to-use application solutions which are employed within the meaning of the invention for cleaning hard surfaces in a spraying procedure have a pH value of ≧7. Such application solutions are prepared by simply admixing the surfactant combinations with water.

The invention is illustrated in detail by the following Examples.

EXAMPLE 1

Surfactant combinations according to the invention

The abbreviations used hereinbelow have the following meanings: EO=ethylene oxide, PO=propylene oxide.

| | | |
|---|---|---|
| A | 20 | Parts of octanol + 4 EO (c) |
| | 20 | Parts of octanol/decanol + 3 EO-butylether (b) |
| | 7 | Parts of lauryldimethylbenzylammonium chloride (a) |
| | 30 | Parts of fatty alcohol $C_{12-18}$ + 2 EO + 4 PO (d) |
| B | 4 | Parts of decanol + 2.9 EO (c) |
| | 36 | Parts of decanol + 2 EO-butylether (b) |
| | 7 | Parts of lauryldimethylbenzylammonium chloride (a) |
| C | 2 | Parts of octanol/hexadecanol + 4 EO (c) |
| | 4 | Parts of octanol/decanol + 4 EO-butylether (b) |
| | 5 | Parts of N-benzyl-N-2-hydroxydodecyl-N,N-dimethyl ammonium isononanoate (a) |
| D | 6 | Parts of octadecenol + 2 EO (c) |
| | 2 | Parts of fatty alcohol $C_{12-14}$ + 10 EO-butyl ether (b) |
| | 13 | Parts of N-benzyl-N-2-hydroxydodecyl-N,N-dimethyl-ammonium isononanoate (a) |
| E | 15 | Parts of octanol + 4 EO-butylether (b) |
| | 3 | Parts of N-Benzyl-N-2-hydroxydodecyl-N,N-dimethyl-ammonium benzoate (a) |
| | 2 | Parts of fatty alcohol $C_{12-18}$ − 2 EO − 4 PO (d) |
| F | 15 | Parts of octanol/decanol + 4 EO-butylether (b) |
| | 1 | Part of lauryldimethylbenzylammonium chloride (a) |
| G | 2 | Parts of octanol + 10 EO (c) |
| | 4 | Parts of octanol/decanol + 4 EO-butylether (b) |
| | 5 | Parts of N-benzyl-N-2-hydroxydodecyl-N,N-dimethyl- |

-continued ammonium isononanoate (a)
5 Parts of fatty alcohol $C_{12-18}$ + 3 EO + 6 PO (d)

EXAMPLE 2

Cleaner bases, as additives to the surfactant combinations according to the invention Base 1:

55.3 Parts of water
7.0 Parts of ethanolamine
10.0 Parts of triethanolamine
8.0 Parts of diethanolamine
15.0 Parts of branched carboxylic acid having 9 carbon atoms
1.0 Part of 2-phosphonobutane-1,2,4-tricarboxylic acid
0.2 Parts of tolyltriazole
3.5 Parts of pentapotassium triphosphate Base 2:

59.2 Parts of water
10.0 Parts of ethanolamine
10.0 Parts of triethanolamine
5.0 Parts of diisopropanolamin
5.0 Parts of n-octanoic acid
2.0 Parts of branched carboxylic acid having 9 carbon atoms
5.0 Parts of branched carboxylic acid having 8 carbon atoms
3.0 Parts of boric acid
0.8 Parts of polyacrylate (MW about 1,500)

Base 3:

54.0 Parts of water
20.0 Parts of triethanolamine
5.0 Parts of diisopropanolamine
5.0 Parts of triisopropanolamine
10.0 Parts of mixture of branched carboxylic acids having from 9 to 11 carbon atoms
2.5 Parts of sodium gluconate
3.5 Parts of hexahydrotriazine derivative Base 4:

72.3 Parts of water
9.0 Parts of potassium hydroxide
2.5 Parts of sodium hydroxide
5.0 Parts of pentapotassium triphosphate
5.0 Parts of potassium gluconate
5.0 Parts of mixture of branched carboxylic acids having from 9 to 11 carbon atoms
1.2 Parts of 1-hydroxyethane-1,1-diphosphonic acid Base 5:

30.3 Parts of pentasodium triphosphate
30.3 Parts of tetrasodium diphosphate
30.3 Parts of trisodiumphosphate * 12 $H_2O$

EXAMPLE 3

The application-technological properties of the surfactant combinations of Example 1 to be used according to the invention were tested in cleaner bases according to Example 2 in a laboratory spray unit. In this test, steel sheets (quality St 37) contaminated with an anticorrosive oil were treated by a spray procedure (spraying pressure from 2.5 to 5 bars) with aqueous application solutions which are characterized in greater detail in the following Table 1. The cleaning effect, foaming property as well as wetting of the sheet surfaces and the property of run-off from the sheet surfaces of the application solutions were visually evaluated.

In all cases of the individual Examples summarized in Table 1 there was observed a good cleaning effect of the tested application solutions. It was further found that the application solutions were readily sprayable at the temperatures set forth in Table 1 and did not exhibit any adverse foaming. The results obtained with respect to the "wetting" and "run-off" properties are listed in Table 1 in the column "Remarks".

The individual columns of Table 1 are explained hereinbelow:

"Base": Number of the cleaner base according to Example 2 used in the respective Test Example.

"Surfactant combination": Designation (code letter) of the surfactant combination according to Example 1 used in the respective Test Example.

"Amount": means the respective concentration (in % by weight) of the surfactant combination relative to the "Concentration": Concentration (in g/l) of the cleaner in the application solution.

"Spraying temperature": Temperature of the application solution when used in the spray procedure without occurrence of any adverse foaming.

Fully deionized water was used in all of the tests.

TABLE 1

PRACTICAL USE TESTS

| Example Number | Base Number | Surfactant Code | Combination Amount* (% by Weight) | Concentration (g/l) | Spraying Temperature °C. | Remarks |
|---|---|---|---|---|---|---|
| 3.1 | 1 | A | 3 | 20 | 15 | Very uniform wetting and uniform run-off |
| 3.2 | 2 | E | 5 | 20 | 20 | As in Example 3.1 |
| 3.3 | 3 | C | 2 | 20 | 15 | As in Example 3.1 |
| 3.4 | 4 | D | 2 | 20 | 20 | — |
| 3.5 | 5 | F | 2 | 10 | 20 | Quick and spot free run-off |
| 3.6 | 1 | B | 2 | 20 | 15 | As in Example 3.6 |
| 3.7 | 3 | G | 3 | 15 | 20 | As in Example 3.6 |
| 3.8 | — | C | 100 | 5 | 20 | As in Example 3.6 |
| 3.9 | — | F | 100 | 5 | 15 | As in Example 3.6 |

*Amount relative to the base

EXAMPLE 4

Mixture 1*:

20 Parts of fatty alcohol $C_{12-14}$ + 10 EO-butylether (b)
80 Parts of lauryldimethylbenzylammonium chloride (a)

Mixture 2:

85 Parts of fatty alcohol $C_{12-18}$ + 5 EO-butylether (b)
15 Parts of lauryldimethylbenzylammonium chloride (a)

Mixture 3:

85 Parts of octanol/decanol + 4 EO-butyl ether (b)
15 Parts of lauryldimethylbenzylammonium chloride (a)

Mixture 4:

20 Parts of octanol/decanol + 4 EO-butyl ether (b)
80 Parts of lauryldimethylbenzylammonium chloride (a)

* = Comparative example

The mixtures of 1 to 4 are designed so that the mixed ethers (b) exhibit gradual differences in the fatty alcohol portion as well as in the EO portion. Here the mixed ether 1 is outside of the scope of the invention. On the other hand, the quaternary ammonium compounds (a) are all within the scope of the present invention.

The foaming test as described hereinafter shows that Mixture 1 according to the Comparative Example exhibits strong foaming—in comparison to the mixtures 2 to 4 according to the invention.

Foaming Test according to DIN 53902

Foaming test in the frothing apparatus according to DIN 53902 (foam height in ml)

| | 100 beats/25° C. Mixture | | | |
|---|---|---|---|---|
| t/s | 1* | 2 | 3 | 4 |
| 0 | 800 | 260 | 20 | 350 |
| 30 | 700 | 30 | 10 | 40 |
| 60 | 680 | 30 | 5 | 10 |

| | 100 beats/30° C. Mixture | | | |
|---|---|---|---|---|
| t/s | 1* | 2 | 3 | 4 |
| 0 | 800 | 50 | 10 | 350 |
| 30 | 700 | 15 | 5 | 20 |
| 60 | 750 | <10 | <5 | <5 |

| | 100 beats/5° C. Mixture | | | |
|---|---|---|---|---|
| t/s | 1* | 2 | 3 | 4 |
| 0 | 750 | 40 | 10 | 200 |
| 30 | 700 | 10 | <5 | <5 |
| 60 | 600 | 10 | <5 | 0 |

The invention claimed is:

1. A process for cleaning hard surfaces with a combination of ionic and non-ionic surfactants, containing:

(a) at least one quaternary ammonium compound having the general formula (I):

$$R^1(\text{—CHOH—CHR}^2)_n\text{—N}^{+R^3}R^4R^5X^- \quad \text{(I)},$$

wherein $R^1$ represents a linear or branched alkyl group having from 1 to 22 carbon atoms; $R^2$ represents hydrogen or a linear or branched alkyl group having from 1 to 21 carbon atoms, the total number of the carbon atoms of the substituents $R^1$ and $R^2$ being within the range of from 10 t0 22; n=0 or 1; $R^3$ and $R^4$ represent methyl, ethyl, 2-hydroxyethyl or hydroxypropyl; $R^5$ represents an alkyl group having from 4 to 6 carbon atoms or a phenylalkyl group having from 1 to 3 carbon atoms in the alkyl moiety; and $X^-$ represents a halide or the anion of an organic acid having from 4 to 15 carbon atoms; and (b) at least one alkyl or alkenyl polyethylene glycol mixed ether having the general formula (II):

$$R^6\text{—O—(CH}_2\text{CH}_2\text{—O)}_s\text{—}R^7 \quad \text{(II)},$$

wherein $R^6$ represents a linear alkyl group having from 8 to 10 carbon atoms or a cyclic alkyl group having from 5 to 6 carbon atoms; s represents a number within the range of from 2 to 4.5, and $R^7$ represents a linear alkyl group having 4 carbon atoms or a benzyl group, the ratio by weight of the components (a):(b) being within the range of from 20:1 to 1:20.

2. A process according to claim 1, wherein the ratio by wight of the components (I):(II) is within the range of from 2:1 to 1:10.

3. A process according to claim 2, wherein the anion of component (I) is chloride, bromide, benzoate or benzoate which has been monosubstituted with $CH_3$, $NH_2$, $NO_2$, COOH, OH or $SO_3H$.

4. A process according to claim 2, wherein the quaternary ammonium compound is lauryldimethylbenzylammonium chloride, N-benzyl-N-2-hydroxydodecyl-N,N-dimethylammonium isononanoate or N-benzyl-N-2-hydroxydodecyl-N,N-dimethylammonium benzoate.

5. A process according to claim 4, wherein the surfactant combination additionally contains at least one alkyl or alkenyl ethoxylate having the general formula (III):

$$R^8\text{—O(CH}_2\text{CH}_2\text{—O)}_m\text{—H} \quad \text{(III)},$$

wherein $R^8$ represents a linear or branched alkyl group or alkenyl group having from 6 to 18 carbon atoms or a cyclic alkyl group having from 5 to 6 carbon atoms, and m represents a number within the range of from 2 to 12.

6. A process according to claim 4, wherein the surfactant combination additionally contains at least one alkyl or alkenyl ethoxylate-propoxylate having the general formula (IV):

$$R^9\text{—O(CH}_2\text{CH}_2\text{O)}_p\text{—A—H} \quad \text{(IV)},$$

wherein $R^9$ represents a linear or branched alkyl group or alkenyl group having from 6 to 18 carbon atoms or a cyclic alkyl group having from 5 to 6 carbon atoms, p represents a number within the range of from 2 to 10, and A represents moieties having one of the formulas:

$$\text{—(CH}_2\text{—CH(CH}_3\text{)—O)}_l \text{ and } \text{—(CH(CH}_3\text{)—CH}_2\text{—O)}_r\text{—},$$

the sum of (q+r) being a number within the range of from 2 to 8.

7. A process according to claim 4, wherein the surfactant combination additionally contains an alkyl or alkenyl ethoxylate having the general formula (III);

$$R^8\text{—O(CH}_2\text{CH}_2\text{—O)}_m\text{—H} \quad \text{(III)},$$

wherein $R^8$ represents a linear or branched alkyl group or alkenyl group having from 6 to 18 carbon atoms or a cyclic alkyl group having from 5 to 6 carbon atoms, and m represents a number within the range of from 2 to 12 and an alkyl or alkenyl ethoxylate-propoxylate having the general formula (IV):

$$R^9\text{—O(CH}_2\text{CH}_2\text{O)}_p\text{—A—H} \quad \text{(IV)},$$

wherein $R^9$ represents a linear or branched alkyl group or alkenyl group having from 6 to 18 carbon atoms or a cyclic alkyl group having from 5 to 6 carbon atoms, p represents a number within the range of from 2 to 10, and A represents moieties having one of the formulas:

$$\text{—(CH}_2\text{—CH(CH}_3\text{)—O)}_l \text{ and } \text{—(CH(CH}_3\text{)—CH}_2\text{—O)}_r\text{—},$$

the sum of (q+r) being a number within the range of from 2 to 8.

8. A process according to claim 7, wherein the ratio by weight of the components (I):{(II)+(III)+(IV)} is between 2:1 and 1:10.

9. A process according to claim 8, wherein the ratio by weight of the components (b):{(III) and (IV)} is between 10:0 and 1:10.

10. A process according to claim 9, wherein the surfactant combination additionally contains builders, complexing agents, corrosion inhibitors, bases, or acids.

11. A process according to claim 10, wherein the surfactant combination is used in the form of an aqueous solution in a concentration of from 0.0005 to 0.5% by weight.

12. A process according to claim 1, wherein the anion of component (a) is selected from the group consisting of (i) chloride, (ii) bromide, (iii) benzoate and (iv) benzoate which has been mono-substituted with $CH_3$, $NH_2$, $NO_2$, COOH, OH or $SO_3H$.

13. A process according to claim 1, wherein the quaternary ammonium compound is lauryldimethylbenzylammonium chloride, N-benzyl-N-2-hydroxydodecyl-N,N-dimethylammonium isononanoate or N-benzyl-N-2-hydroxydodecyl-N,N-dimethylammonium benzoate.

14. A process according to claim 3, wherein the surfactant combination additionally contains at least one alkyl or alkenyl ethoxylate having the general formula (III):

$$R^8—O(CH_2CH_2—O)_m—H \quad \text{(III)},$$

wherein $R^8$ represents a linear or branched alkyl group or alkenyl group having from 6 to 18 carbon atoms or a cyclic alkyl group having from 5 to 6 carbon atoms, and m represents a number within the range of from 2 to 12.

15. A process according to claim 3, wherein the surfactant combination additionally contains at least one alkyl or alkenyl ethoxylate-propoxylate having the general formula (IV):

$$R^9—O(CH_2CH_2O)_p—A—H \quad \text{(IV)},$$

wherein $R^9$ represents a linear or branched alkyl group or alkenyl group having from 6 to 18 carbon atoms or a cyclic alkyl group having from 5 to 6 carbon atoms, p represents a number within the range of from 2 to 10, and A represents moieties having one of the formulas:

$$—(CH_2—CH(CH_3)—O)_q \text{ and}$$
$$—(CH(CH_3)—CH_2—O)_4—,$$

the sum of (q+r) being a number within the range of from 2 to 8.

16. A process according to claim 3, wherein the surfactant combination additionally contains an alkyl or alkenyl ethoxylate having the general formula (III):

$$R^8—O(CH_2CH_2—O)_m—H \quad \text{(III)},$$

wherein $R^8$ represents a linear or branched alkyl group or alkenyl group having from 6 to 18 carbon atoms or a cyclic alkyl group having from 5 to 6 carbon atoms, and m represents a number within the range of from 2 to 12 and an alkyl or alkenyl ethoxylate-propoxylate having the general formula (IV):

$$R^8—O(CH_2CH_2O)_p—A—H \quad \text{(IV)},$$

wherein $R^9$ represents a linear or branched alkyl group or alkenyl group having from 6 to 18 carbon atoms or a cyclic alkyl group having from 5 to 6 carbon atoms, p represents a number within the range of from 2 to 10, and A represents moieties having one of the formulas:

$$—(CH_2—CH(CH_3)—O)_q \text{ and}$$
$$—(CH(CH_3)—CH_2—O)_4—,$$

the sum of (q+r) being a number within the range of from 2 to 8.

17. A process according to claim 6, wherein the ratio by weight of the components (I):{(II)+(III)+(IV)} is between 20:1 and 1:20.

18. A process according to claim 7, wherein the ratio by weight of the components (II):{(III) and (IV)} is between 10:1 and 1:10.

19. A process according to claim 8, wherein the surfactant combination additionally contains builders, complexing agents, corrosion inhibitors, bases, or acids.

20. A process according to claim 1, wherein the surfactant combination in used in the form of an aqueous solution in a concentration of from 0.0001 to 1.5% by weight.

* * * * *

UNITED STATES PATENT AND TRADEMARK OFFICE

CERTIFICATE OF CORRECTION

PATENT NO. : 5,308,401

DATED : May 3, 1994

INVENTOR(S) : Geke et. al.

It is certified that error appears in the above-indentified patent and that said Letters Patent is hereby corrected as shown below:

On the title page, section [54] title, after "CLEANING", insert:
-- USING --.

In claim 1, column 9, line 51, "tO", should read:
-- to --.

In claim 6, column 10, line 39, "$-(CH_2-CH(CH_3)-O)_1$", should read:
-- $-(CH_2-CH(CH_3)-O)_q$ --.

In claim 7, column 10, line 64, "$-(CH_2-CH(CH_3)-O)1$", should read:
-- $-(CH_2-CH(CH_3)-O)q$ --.

In claim 9, column 11, line 5, "(b)", should read:
-- II --.

In claim 12, column 11, line 15, "(a)", should read:
-- I --.

UNITED STATES PATENT AND TRADEMARK OFFICE

CERTIFICATE OF CORRECTION

PATENT NO. : 5,308,401

DATED : May 3, 1994

INVENTOR(S) : Geke et. al.

It is certified that error appears in the above-indentified patent and that said Letters Patent is hereby corrected as shown below:

In claim 15, column 12, line 5, "$-(CH(CH_3)-CH_2-O)_4-$", should read:
-- $-(CH(CH_3)-CH_2-O)_r-$ --.

In claim 16, column 12, line 30, "$-(CH(CH_3)-CH_2-O)_4-$", should read:
-- $-(CH(CH_3)-CH_2-O)_r-$ --.

In claim 20, column 12, line 44, "in used", should read:
-- is used --.

Signed and Sealed this

Twenty-fifth Day of July, 1995

*Attest:*

Bruce Lehman

BRUCE LEHMAN

*Attesting Officer*

*Commissioner of Patents and Trademarks*